US005085186A

United States Patent [19]

Kobayashi

[11] Patent Number: 5,085,186

[45] Date of Patent: Feb. 4, 1992

[54] CRANKSHAFT AND JOURNAL ARRANGEMENT FOR ENGINE

[75] Inventor: Manabu Kobayashi, Iwata, Japan

[73] Assignee: Yamaha Hatsudoki Kabushiki Kaisha, Iwata, Japan

[21] Appl. No.: 558,829

[22] Filed: Jul. 26, 1990

[30] Foreign Application Priority Data

Jul. 28, 1989 [JP] Japan ..... 1-195649
Aug. 31, 1989 [JP] Japan ..... 1-222966

[51] Int. Cl.[5] ..... F02F 7/00

[52] U.S. Cl. ..... 123/195 R; 123/195 H; 180/291; 74/665 B

[58] Field of Search ..... 123/195 R, 195 H; 74/15.63, 15.69, 15.8, 15.82, 15.84, 15.88, 421 A, 665 B; 180/291, 297, 292

[56] References Cited

U.S. PATENT DOCUMENTS

| | | | |
|---|---|---|---|
| 1,341,709 | 6/1920 | Dodge | 74/665 B |
| 2,075,741 | 3/1937 | Miller | 74/665 B |
| 2,441,446 | 5/1948 | Schitter | 74/421 A |
| 3,234,808 | 2/1966 | Nelson | 74/421 A |
| 4,331,212 | 5/1982 | Tsuboi | 74/15.84 |
| 4,412,514 | 11/1983 | Hayakawa et al. | 123/195 R |
| 4,448,279 | 5/1984 | Watanabe et al. | 180/297 |
| 4,512,292 | 4/1985 | Hundertmark | 74/15.63 |
| 4,708,027 | 11/1987 | Stenner | 74/421 A |
| 4,821,826 | 4/1989 | Lings | 123/195 R |
| 4,838,221 | 6/1989 | Suemori | 123/195 H |
| 4,848,170 | 7/1989 | Inagaki et al. | 74/6 |
| 4,955,343 | 9/1990 | Ogami | 123/195 R |

FOREIGN PATENT DOCUMENTS

| | | | |
|---|---|---|---|
| 0196871 | 10/1986 | European Pat. Off. | 180/297 |
| 0221720 | 12/1983 | Japan | 180/291 |
| 0249517 | 10/1987 | Japan | 180/297 |

*Primary Examiner*—Raymond A. Nelli
*Assistant Examiner*—Thomas N. Moulis
*Attorney, Agent, or Firm*—Ernest A. Beutler

[57] ABSTRACT

A compact power unit for an internal combustion engine including a bearing arrangement for the crankshaft which includes a combined crankcase member and bearing cap that has integral bearing journals for the crankcase and which also forms at least in part the crankcase closure. An output shaft for powering a vehicle is also journaled by the cylinder block and crankcase member and is driven by an integral gear formed on one of the throws of the crankshaft. A balancing arrangement for accommodating this non balanced throw and for maintaining equal cylinder bore spacing is also employed.

33 Claims, 13 Drawing Sheets

CRANKSHAFT AND JOURNAL ARRANGEMENT FOR ENGINE

BACKGROUND OF THE INVENTION

This invention relates to an crankcase and journal arrangement for an internal combustion engine and more particularly to an improved compact and high strength arrangement for journaling a crankshaft for an engine.

It is well known that internal combustion engines, particularly those which are employed as power units in motor vehicles, should be very compact in nature. This is particularly true when the engine is positioned transversely in the engine compartment, as is the current practice in many types of front wheel drive vehicles or rear engine, rear wheel drive vehicles. In order to provide such a compact assembly, it has been proposed to employ an engine arrangement wherein the crankshaft of the engine does not directly output the drive for the vehicle. Rather, an output shaft is journaled for rotation about an axis parallel to the crankshaft and is driven from the crankshaft and supplies the motive power for the vehicle. Such arrangements provide certain advantages in compact assembly.

In conjunction with such arrangements, the output shaft need not have the same length as the engine crankshaft. In fact, it is desirable to provide an output shaft that is shorter in length than the engine crankshaft so as to reduce the overall size of the engine. However, it is also advantageous to rotatably journal the output shaft within the same crankcase chamber as the crankshaft. If this is done with conventional arrangements, the total crankcase size becomes quite large and, furthermore, the advantages of a compact engine construction can be lost.

It is, therefore, a principal object of this invention to provide an improved crankshaft and output shaft arrangement and associated crankcase for an internal combustion engine that provides a compact assembly.

It is a further object of this invention to provide an improved and compact arrangement for journaling a crankshaft and an output shaft for driving a vehicle within the crankcase of an internal combustion engine.

It is yet another object of this invention to provide an improved, compact output shaft drive system for an engine wherein the output shaft is contained within the crankcase of the engine and yet provide a compact engine construction.

In connection with the journaling arrangement for a engine crankshaft, it is a conventional practice to provide a journal arrangement for the crankshaft which includes bearing portions that are formed by the cylinder block and which cooperate with bearing cap affixed to the cylinder block for journaling the crankshaft. The use of separate bearing caps and individual ones for each crankshaft bearing can reduce the rigidity of the engine. It has been proposed, however, to use a construction wherein a plurality of the bearing caps are formed by a common member that is fixed to the cylinder block. However, when this has been done, this member is contained within a separate crankcase pa that is fixed to the cylinder block. Thus the overall construction becomes quite complicated. Furthermore, the use of such double members does not increase the rigidity of the engine as much as might be hoped.

It is, therefore, a still further object of this invention to provide an improved arrangement for journaling a crankshaft within a engine wherein all of the bearing caps are formed from a common member and yet a separate..closure for the crankcase is not necessary.

It is a further object of this invention to provide an improved combined crankcase closure and bearing cap arrangement for an internal combustion engine.

It has been previously noted that certain advantages can be enjoyed in compaction of the engine package if a separate output shaft is driven from the crankshaft and supplies the output power from the engine. Where this is done, it is desirable to drive this output shaft from a point between the ends of the crankshaft so as to provide a more compact construction. One way this can be done is by providing a gear drive for the output shaft with the gear drive being formed by an integral gear formed on the crankshaft at one of the throws. However, when this is done, the balancing arrangement for the crankshaft can be upset.

It is, therefore, a further object of this invention to provide an improved crankshaft for an internal combustion engine that has a drive for driving an output shaft from a point at one of the journals of the engine and wherein the balancing of the crankshaft is facilitated.

SUMMARY OF THE INVENTION

A first feature of this invention is adapted to be embodied in an internal combustion engine that is comprised of a cylinder block with a plurality of aligned cylinder bores. A crankcase portion is formed in the cylinder block at the base of the cylinder bores and a crankcase member is affixed to the cylinder block crankcase portion and defines therewith, at least in part, a crankcase chamber. A crankshaft having a plurality of spaced bearings is journaled within the crankcase chamber and is driven by the pistons contained within the cylinder bores. An output shaft is journaled within the crankcase chamber for rotation about an axis parallel to the axis of rotation of the crankshaft and lying a common plane therewith. Means are provided for driving the output shaft from the crankshaft between the ends of the crankshaft. The crankcase chamber has a first longitudinally extending cavity in the plane which contains the crankshaft and a second substantially shorter longitudinally extending cavity at one side of the first cavity and containing the output shaft.

Another feature of the invention is also adapted to be embodied in an internal combustion engine that is comprised of a cylinder block with a plurality of aligned cylinder bores and a crankcase portion that is formed in the cylinder block at the base of the bore. A crankcase member is affixed to the cylinder block crankcase portion and defines therewith, at least in part, a crankcase chamber. A crankshaft having a plurality of spaced bearings is positioned within the crankcase chamber and is driven by pistons contained within the cylinder bores. The crankcase member comprises a unitary assembly forming a plurality of spaced bearing caps that cooperate with bearing surfaces formed in the cylinder block for journaling the crankshaft for its rotation. The crankcase member forms a closure around the peripheral edge of the cylinder block crankcase portion.

A still further feature of the invention is adapted to be embodied in a crankcase for an internal combustion engine having a plurality of spaced main bearing portions and a plurality of connecting rod journal portions offset from the main bearing portions and connected thereto by throws, at least one of the throws intermediate the ends of the crankshaft is formed with an integral gear portion on one cheek for driving an output shaft. A disk like member is formed on the adjacent cheek of the throw on the opposite side of the main bearing portion of the crankshaft.

DETAILED DESCRIPTION OF THE PREFERRED EMBODIMENTS OF THE INVENTION

Figure 1:
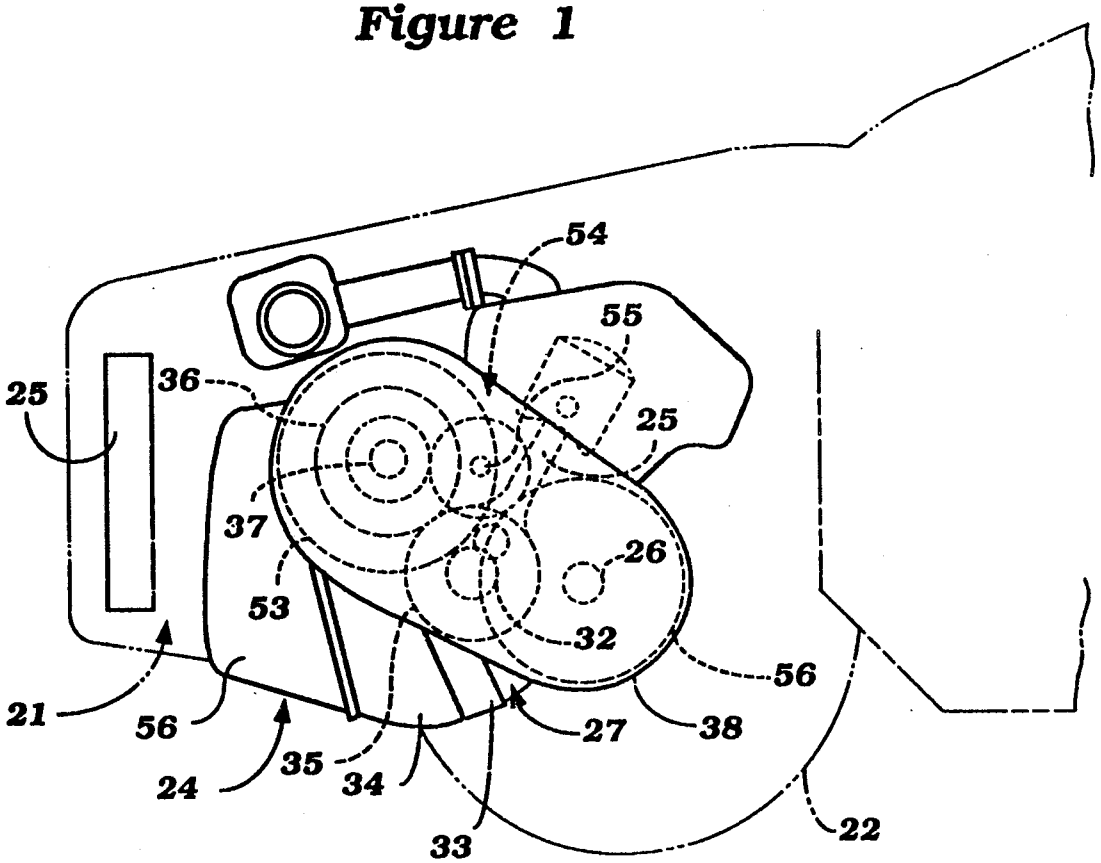
FIG. 1 is a partial side elevational view of a motor vehicle powered by an internal combustion engine constructed in accordance with an embodiment of the invention, with portions of the vehicle shown in phantom.
Figure 2:
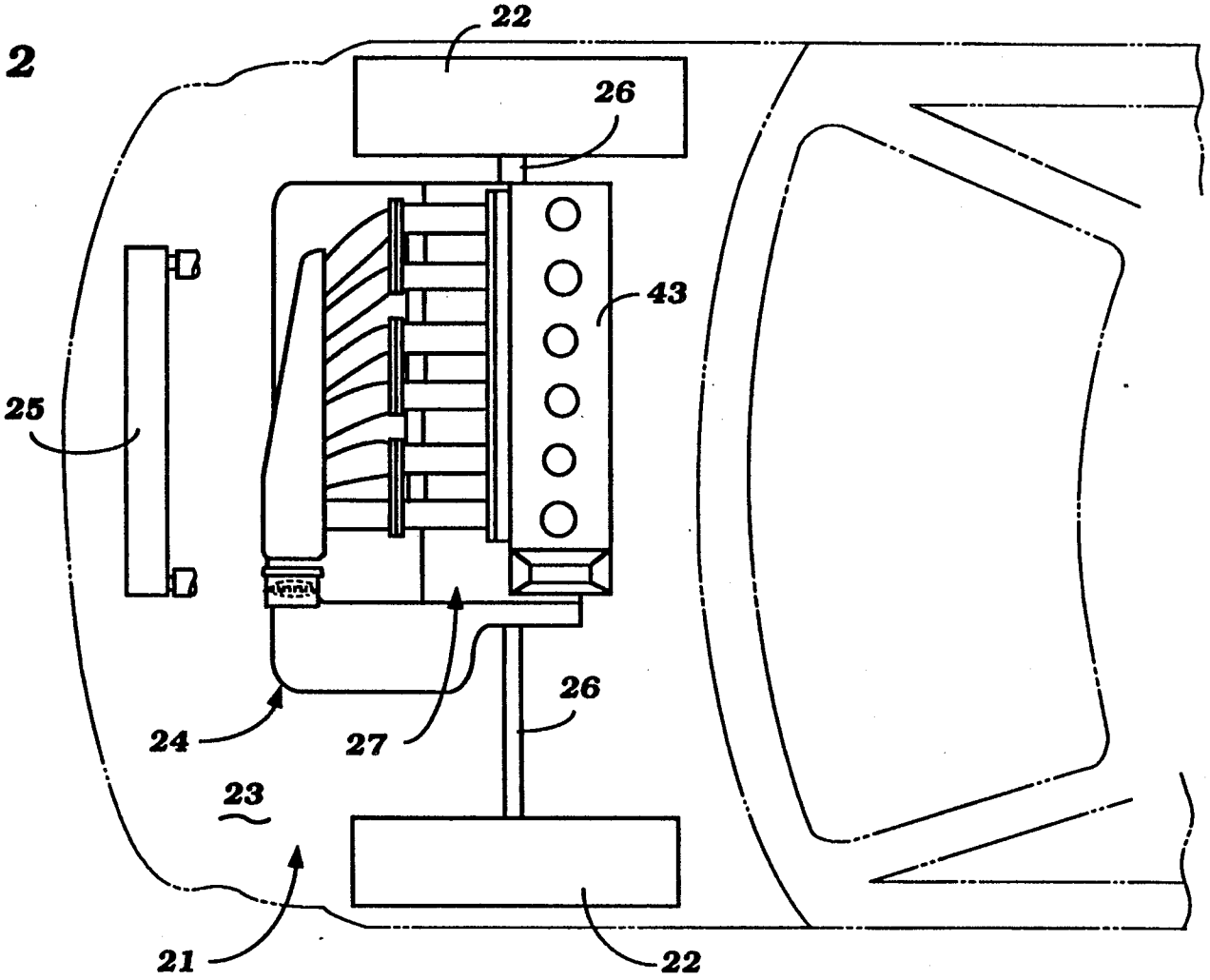
FIG. 2 is a top plan view of the area of the vehicle shown in FIG. 1 with the same components shown in phantom.

Referring first primarily to FIGS. 1 and 2, the front portion of a motor vehicle constructed in accordance with an embodiment of the invention is identified generally by the reference numeral 21. In the illustrated embodiment, the vehicle 21 is of the transverse engine, front wheel drive type and since the invention relates to the power unit for driving the front wheels 22, only that portion of the vehicle has been illustrated. It is to be understood, however, that the invention may also be employed in conjunction with rear engine, rear wheel drive vehicles or, for that matter, in connection with other applications for internal combustion engines.

The vehicle 21 is formed with a transversely extending engine compartment 23 in which a power unit constructed in accordance with an embodiment of the invention is contained, which power unit is identified generally by the reference numeral 24. The power unit 24 is positioned rearwardly of a radiator 25 for cooling of the engine portion of the power unit 24 which radiator receives cooling air through a grill opening positioned at the forward portion of the engine compartment 23. The power unit 24 drives the front wheels 22 through a pair of front axles 26 in a manner to be described.

The power unit 24 has a construction of the type generally described in the copending application entitled "Engine Unit For Vehicle", Ser. No. 270,357, filed Nov. 14, 1988 in my name and the name of Kaoru Okui and assigned to the Assignee hereof. Because of the similarities and the fact that this invention relates primarily to the crankcase construction and journaling arrangement for the crankshaft, the crankcase and the output drive, components of the power unit which are the same or substantially the same as that of the previously described embodiment will not be described herein and reference may be had to that copending application for details thereof. The disclosure of that application is incorporated herein by reference.

Figure 6:
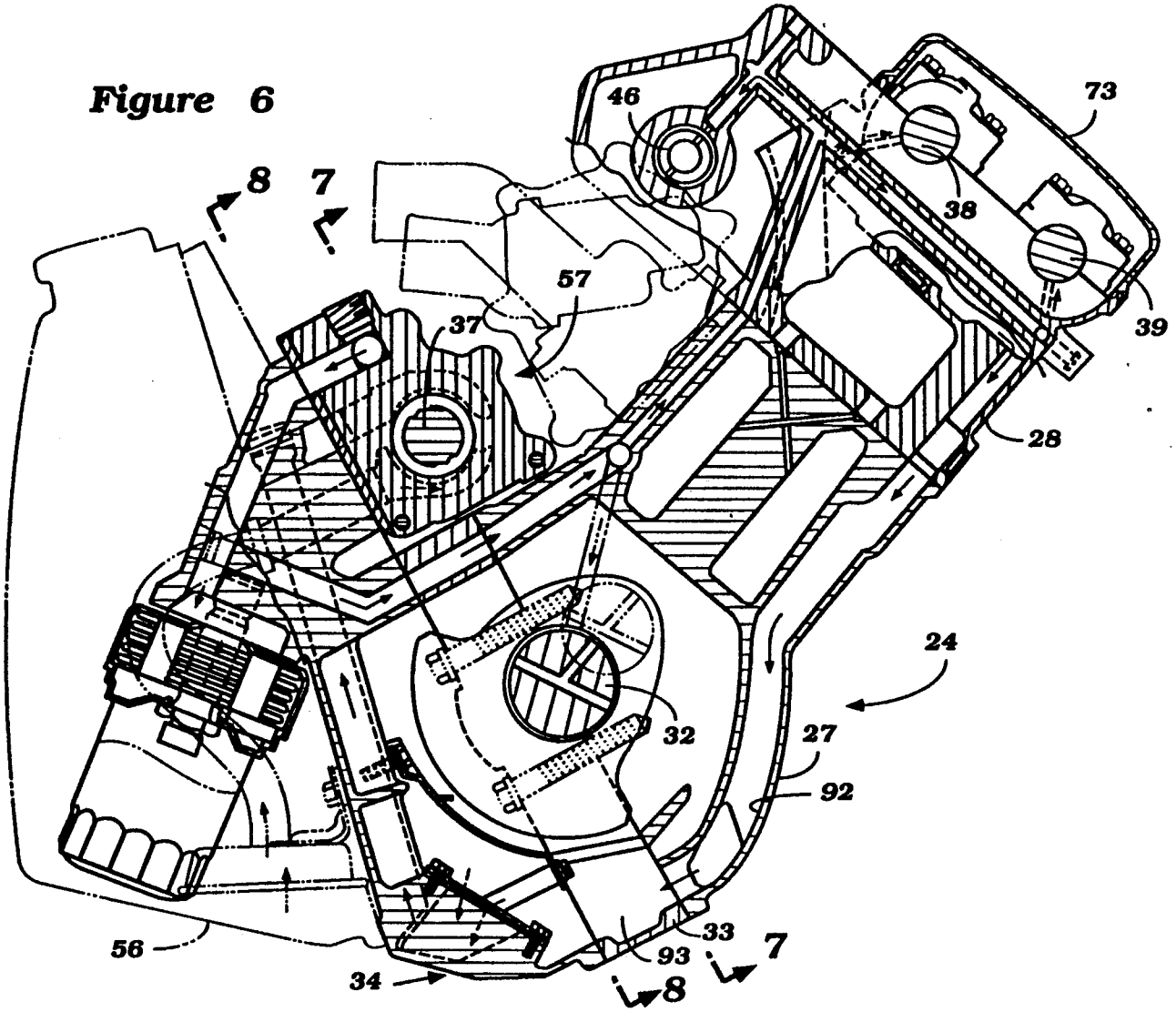
FIG. 6 is a cross sectional view of the complete engine but is taken along the line 6—6 of FIG. 5.

Basically, the power unit 24 includes a six cylinder in line engine although the invention can be utilized in conjunction with engines having different numbers of cylinders and certain aspects of the engine can also be employed with V type engines. The engine portion of the power unit 24 is comprised of a cylinder block 27 (FIGS. 3 and 6) which is, in the preferred embodiment, formed from cast iron, to which a cylinder head 28 is affixed in a suitable manner. The cylinder block 27 has a first portion 29 in which the cylinder bores are formed and a lower crankcase portion 31. A crankshaft 32 is journaled within a crankcase chamber formed by the cylinder block crankcase portion 31, a first crankcase member 33 and a second crankcase member 34, which are connected together in a manner to be described and by a bearing arrangement which will be described.

Figure 3:
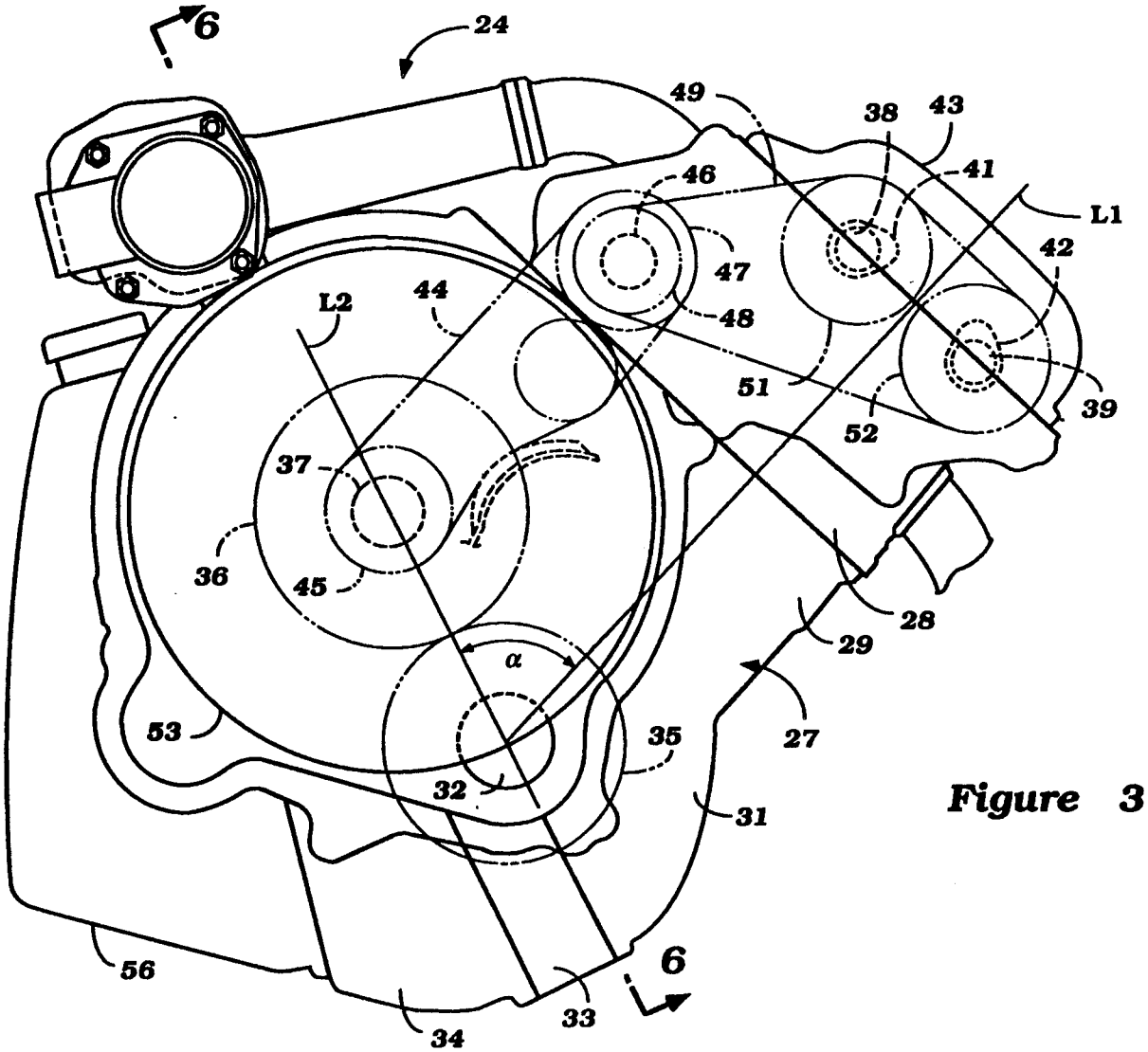
FIG. 3 is an enlarged side elevational view of the power unit.

The bores of the cylinder block 27 all have their axes inclined to the vertical and lying a common plane indicated by the line L1 in FIG. 3, which is disposed at an acute angle to the vertical. The cylinder block crankcase portion 31 and crankcase member 33 are affixed together along a mating plane indicated by the line L2 which is inclined forwardly from the vertical at an acute angle. The planes L1 and L2 are disposed at an acute angle to each other so as to provide a very compact engine assembly. The axis of rotation of the crankshaft 32 as defined by the bearing assembly lies on the intersection of the planes L1 and L2.

A timing gear 35 is formed integrally on the crankshaft 32 in a manner to be described and at a location between its ends. The timing gear 35 meshes with a further timing gear 36 that is affixed to or integral with an output shaft 37 which is journaled, in a manner to be described, about a rotational axis that also lies on the plane L2 and the plane defined by the parting line between the crankcase member 32 and the crankcase portion 31 of the cylinder block 27.

The engine portion of the power unit 24 includes a pair of overhead camshafts 38 and 39 which have individual cam lobes 41 and 42 for operating intake and exhaust valves (not shown) that are reciprocally supported in the cylinder head 28. A cam cover 43 encloses the camshafts 38 and 39.

The camshafts 38 and 39 are driven by a two stage camshaft driving mechanism of the type generally described in aforenoted copending application Ser. No. 270,357 and which includes a first timing chain 44 that is trained around a sprocket 45 on the output shaft 37 and which drives a cam driving shaft 46 journaled o the cylinder head assembly 28 by means of a sprocket 47. A further sprocket 48 is affixed to the cam driving shaft 46 and drives a second chain 49 which, in turn, drives sprockets 51 and 52 affixed to the camshafts 38 and 39, respectively. As noted in the aforenoted copending application, the two to one drive ratio between the crankshaft 32 and the camshafts 38 and 39 can be achieved in a pair of stages through the driving mechanism as described herein.

A clutch 53 is affixed to the end of the output shaft 37, as will become more apparent from the remaining figures and descriptions, and drives the axle shafts 26 through a change speed transmission, indicated generally by the reference numeral 54 (FIG. 1), which includes a plurality of change speed gear sets contained on a primary shaft that is coaxially disposed with the output shaft 37 and a secondary shaft 55 that rotates about an axis that is disposed parallel thereto. The secondary shaft is coupled to a final drive assembly 56 that includes a differential of a known type for driving the front axles 26.

The power unit 24 is provided with a lubrication system of the type generally described in the copending application entitled "Engine Construction For Vehicle", Ser. No. 532,200, filed June 1, 1990 in my name and that of Kaoru Okui, and assigned to the Assignee hereof.

This lubricating system includes a dry sump reservoir 56 that is positioned at a forward portion of the power unit and which is supported from the crankcase member 34. In addition, there is a scavenge and pressure pump assembly driven by the output shaft 37 or specifically an extension of it that extends outside of the crankcase chamber and which is identified generally by the reference numeral 57 and which appears in FIGS. 6 and 7. Since the lubrication system forms no part of the invention, it will not be described in detail and the disclosure of the aforenoted copending application is incorporated herein by reference.

The construction and journaling of the crankshaft 32 and the associated output shaft 37 will now be described in detail primarily by reference to FIGS. 7, 8 and 11 through 14. Referring primarily to FIGS. 11 through 14 first, it will be seen that the crankshaft 32 is provided with six connecting rod bearing portions 59, 61, 62, 63, 64 and 65. These bearing portions are formed at the termination of adjacent throws formed by respective cheeks. These pairs of cheeks are indicated by the reference numerals 66, 67; 68, 69; 71, 72; 73, 74; 75, 76; and 77, 78. It should be noted that the timing gear 35 is actually formed integrally with the cheek 75.

The crankshaft 32 is further provided with seven main bearing portions 81, 82, 83, 84, 85, 86 and 87. These main bearing portions 81 through 87 are journaled in webs that are formed in the cylinder block 27 and more particularly the crankcase skirt portion 31 thereof, said bearing portions being identified by the reference numerals 88.

As has been previously noted, the cheek 75 of the crankshaft 32 is formed integrally with the gear portion 36. So as to avoid any imbalances, the parallel cheek 74 on the other side of the main bearing is not counter weighted, but is merely formed like a disk type member. The cheeks 69 and 71, which are equidistant from the center main bearing 84 of the crankshaft are also formed as disk type members. Thus, only the cheeks 67, 68, 72, 73 and 76 are counter-weighted for balancing purposes. As a result, the crankshaft 32 will be well balanced and can provide an extremely compact assembly, as will be seen in the Figures.

Figure 11:
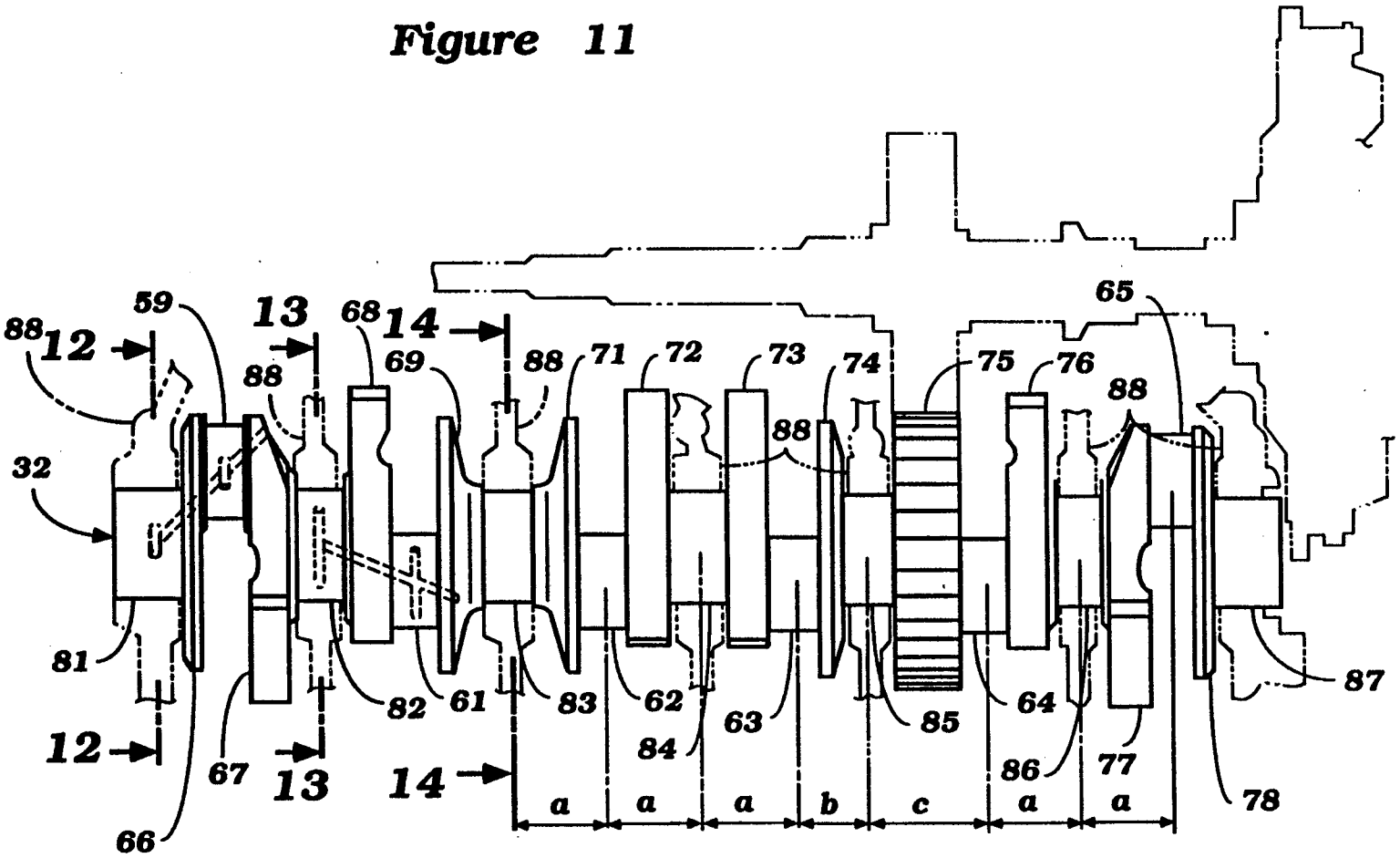
FIG. 11 is a top plan view of the crankshaft with certain auxiliary components being shown in phantom.
Figure 12:
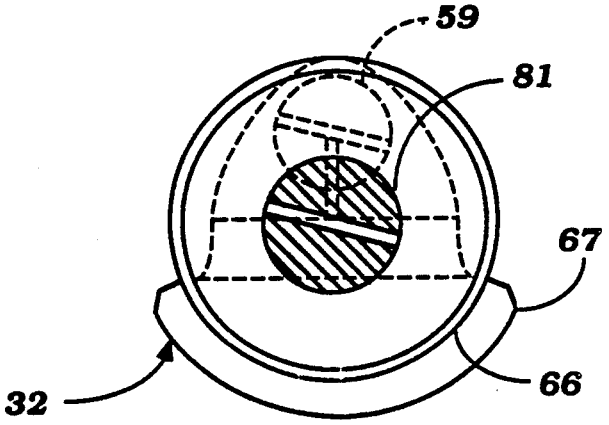
FIG. 12 is a cross sectional view taken along the line 12—12 of FIG. 11.
Figure 13:
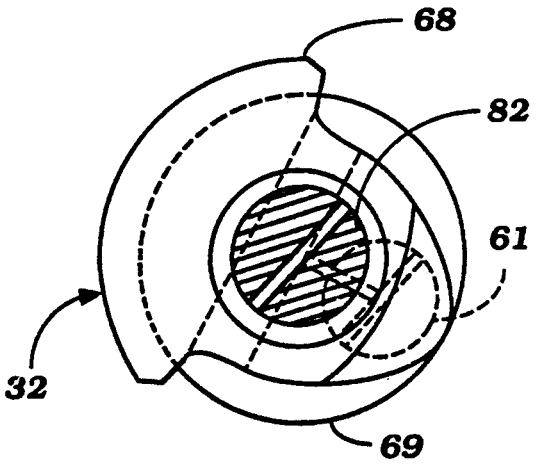
FIG. 13 is a cross sectional view taken along the line 13—13 of FIG. 11.
Figure 14:
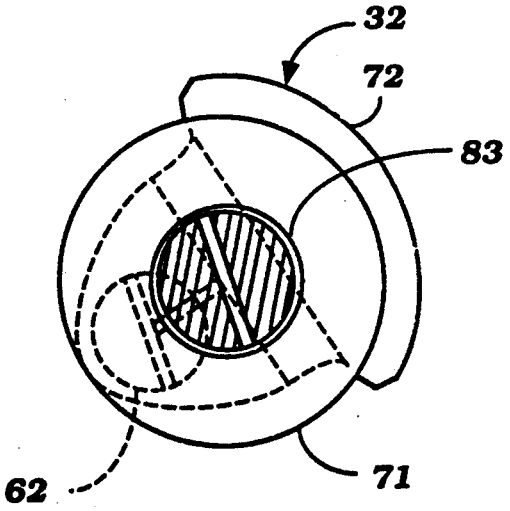
FIG. 14 is a cross sectional view taken along the line 14—14 of FIG. 11.

As will be seen from FIG. 11, the distance A between the center of each main bearing portion and the adjacent connecting rod journal portion is the same, except for those associated with the main bearing portion 85 adjacent which the gear 35 is formed. In this case, the distance between the main bearing portion 85 and the connecting rod journal portion 63 on opposite sides of the disk like cheek 73 is smaller (dimension b) so that the distance between the main bearing portion 85 and the connecting rod journal 64 may be larger (dimension c) so as to permit a wider gear tooth arrangement. However, this permits the cylinder spacing to be the sam between all cylinders.

Figure 9:
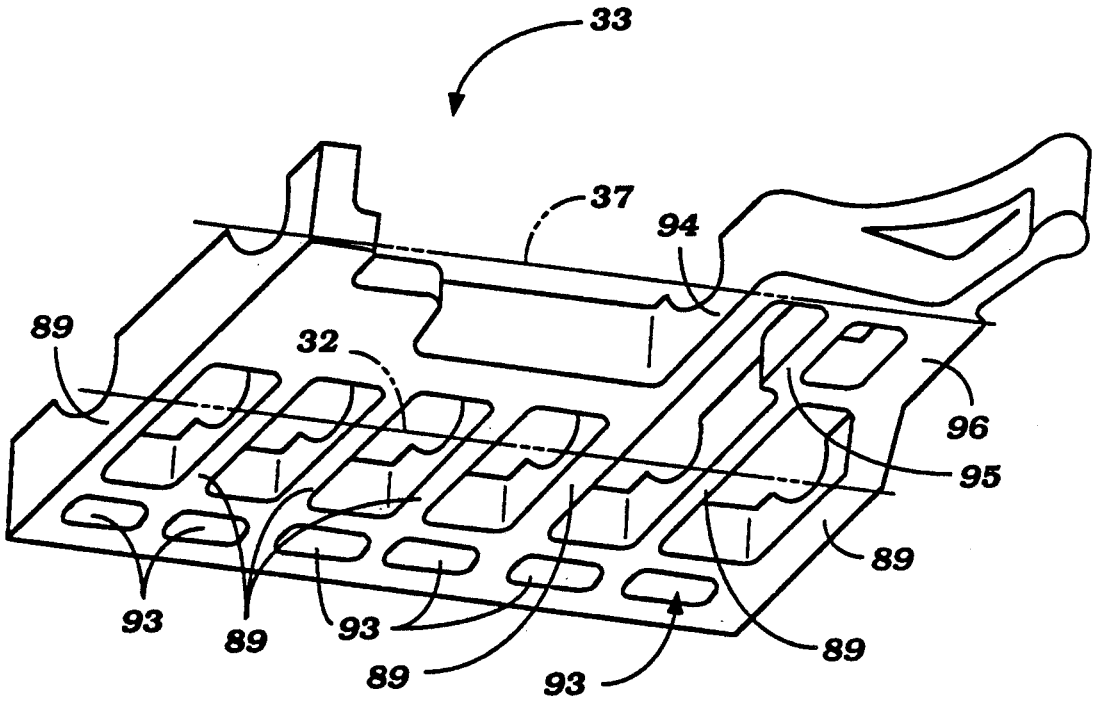
FIG. 9 is a perspective view of the crankcase member that forms the part of the bearing cap assembly for the crankshaft of the engine.
Figure 10:
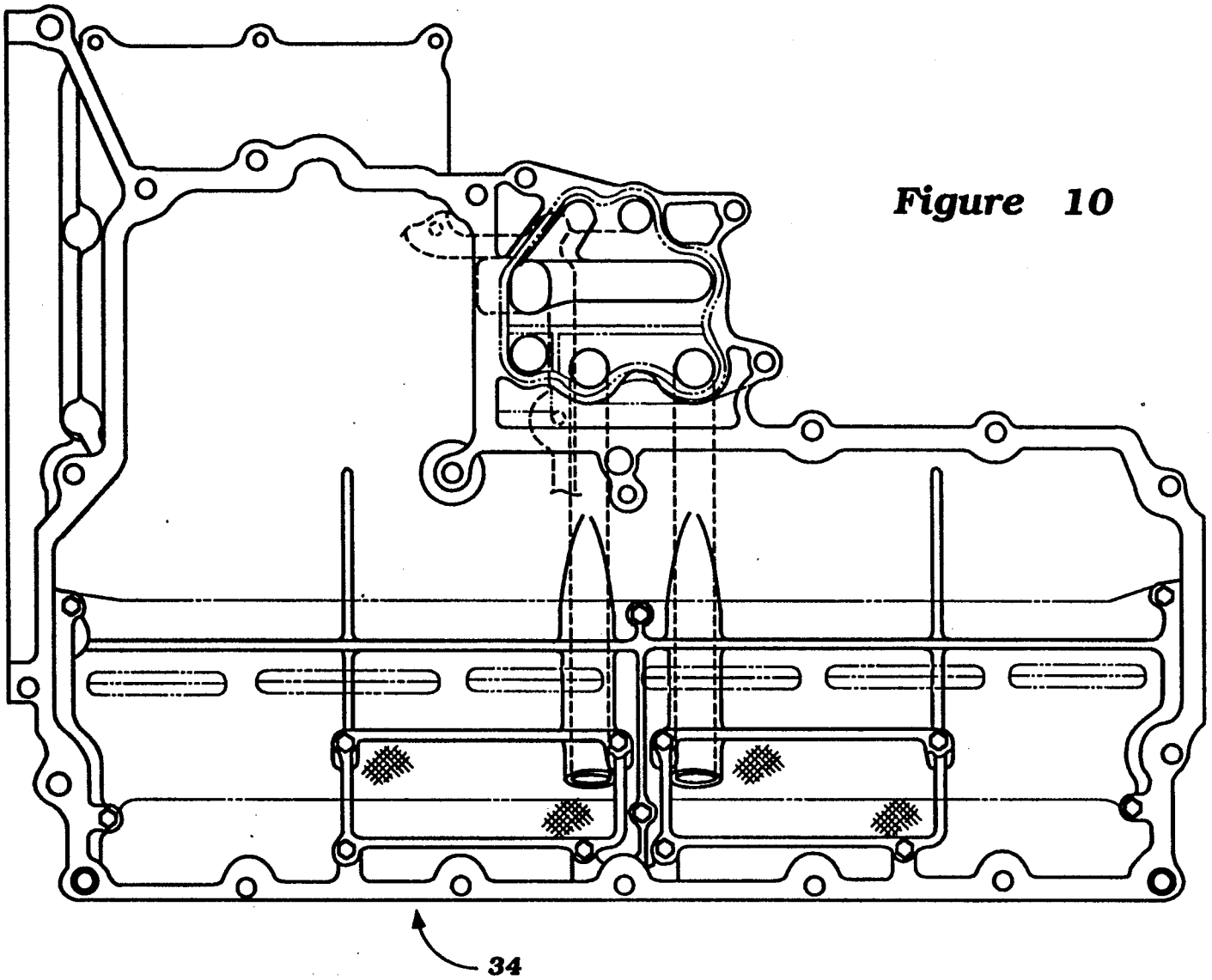
FIG. 10 is a plan view of the remaining crankcase member and looking generally in the opposite direction from FIG. 8.

It should be noted that the first crankcase member 33, as is best shown in FIG. 9, is formed from a cast iron construction and has a box like configuration with webs 89 which are formed with bearing portions for cooperating with those webs 88 of the cylinder block 27 to receive plain bearings (not shown) for journaling the crankshaft 32. It should be noted from FIG. 9 that the area between the webs 89 is left open but nevertheless the construction is extremely rigid and robust. Threaded fasteners such as studs or the like 91 are affixed to the cylinder block 27 and are utilized to secure the first crankcase member 33 to the cylinder block. Because of the unitary construction of the crankcase member 33 and the fact it also forms the bearing caps for the crankshaft, an extremely rigid construction will result.

It should be noted that at one side of the crankcase chamber in which the crankshaft 32 is journaled, the cylinder block is provided with oil drain passages 92 which cooperate with corresponding oil drain passages 93 formed in the crankcase member 33 so as to permit oil to drain back from the cylinder head and camshaft mechanism into the lubricant sump where it will be picked up and returned to the dry sump tank 56 as described in aforenoted copending application Ser. No. 532,200.

Figure 7:
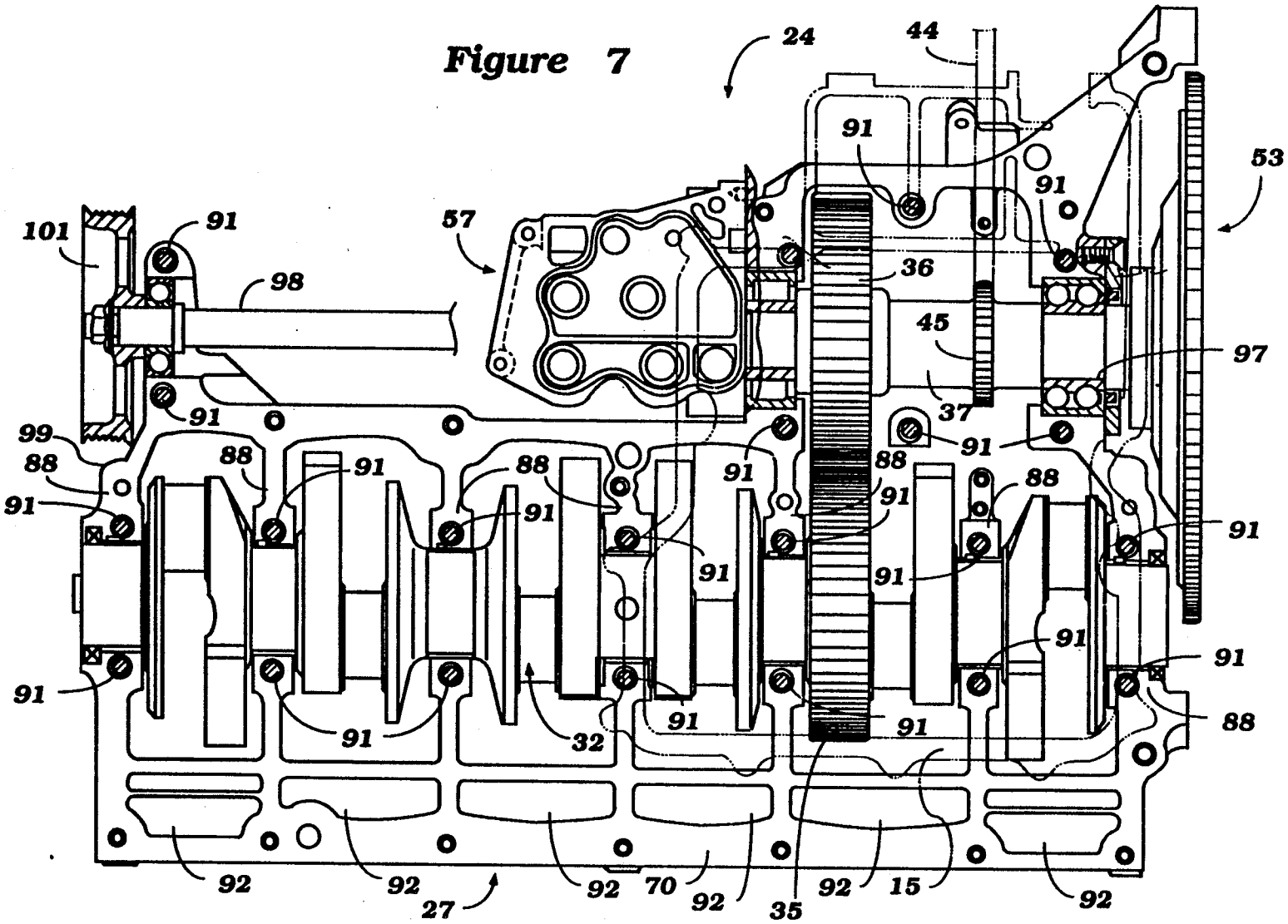
FIG. 7 is a cross sectional view taken along the line 7—7 of FIG. 6.
Figure 8:
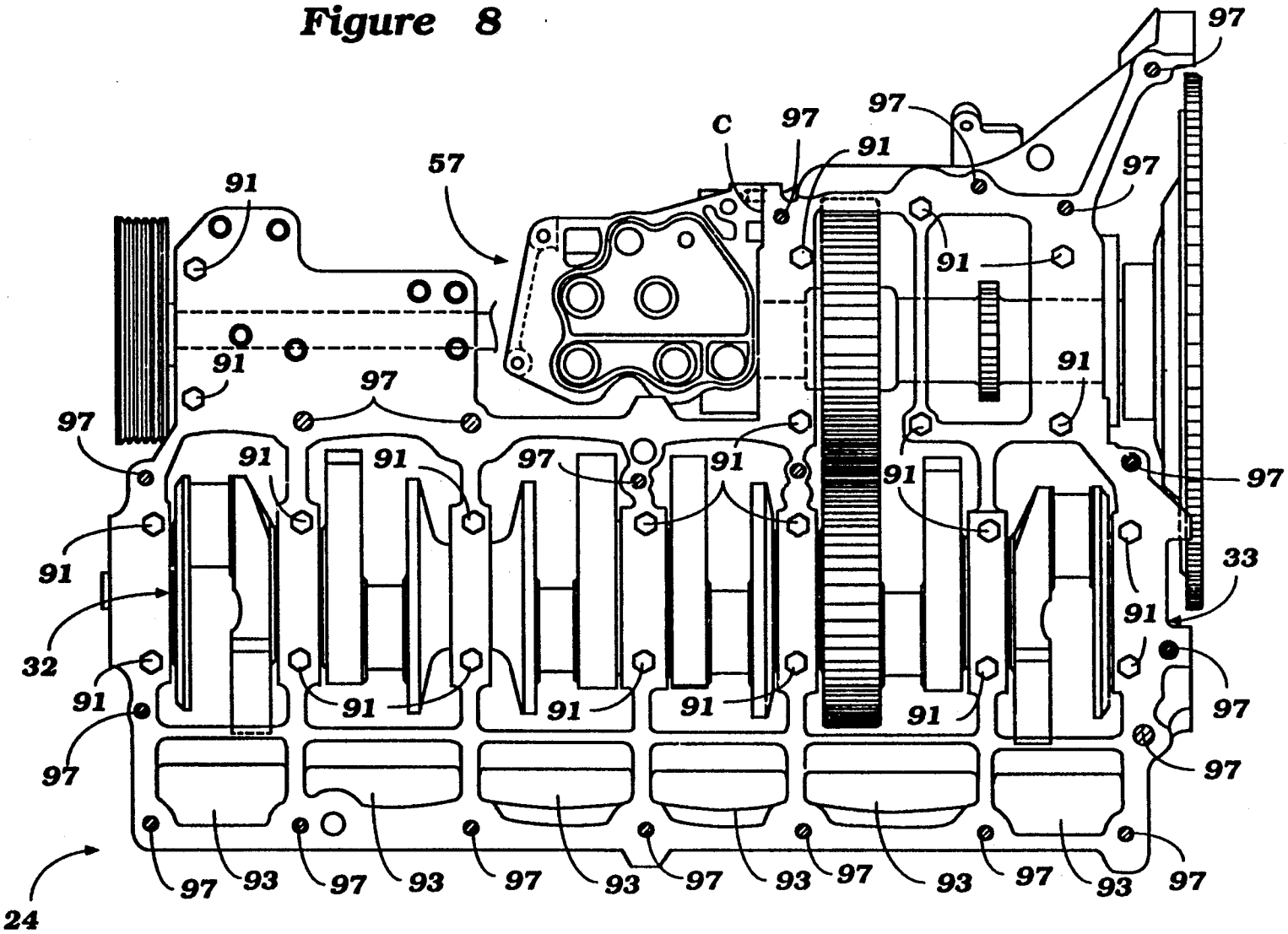
FIG. 8 is a cross sectional view taken along the line 8—8 of FIG. 6.

A journaling arrangement for the output shaft 37 will now be described by primary reference to FIGS. 7 through 9. It should be noted that the cylinder block web 88 that journals the main bearing portion adjacent the timing gear 35 is extended transversely outwardly so that the crankcase chamber defined by the cylinder block 27 and crankcase members 33 and 34 has a generally L shaped configuration. A portion of the output shaft 37 is journaled therein and the crankcase member 33 is formed with a further web or web extension 94 of one of its webs 89 so as to provide this bearing surface. In addition, there is provided an intermediate web 95 and an end web 96, each of which cooperates with bearing portions on the output shaft 37 for its journaling.

It should be noted that a double roller bearing 97 is provided at the clutch end 53 of the output shaft 37. This is staggered slightly inwardly from the end web 88 that supports the main bearing journal 87 of the crankshaft 32 so as to provide a compact assembly and to permit the clutch disk 53 to overlap the end of the crankshaft 32 as clearly shown in FIGS. 7 and 8. As a result, a further strengthening of the overall assembly is achieved. In addition to the fasteners 91 previously described, there are additional fasteners 97 that cooperate so as to secure the crankcase member 33 to the cylinder block 27. The fasteners 97 have a smaller diameter than the fasteners 91.

Figure 4:
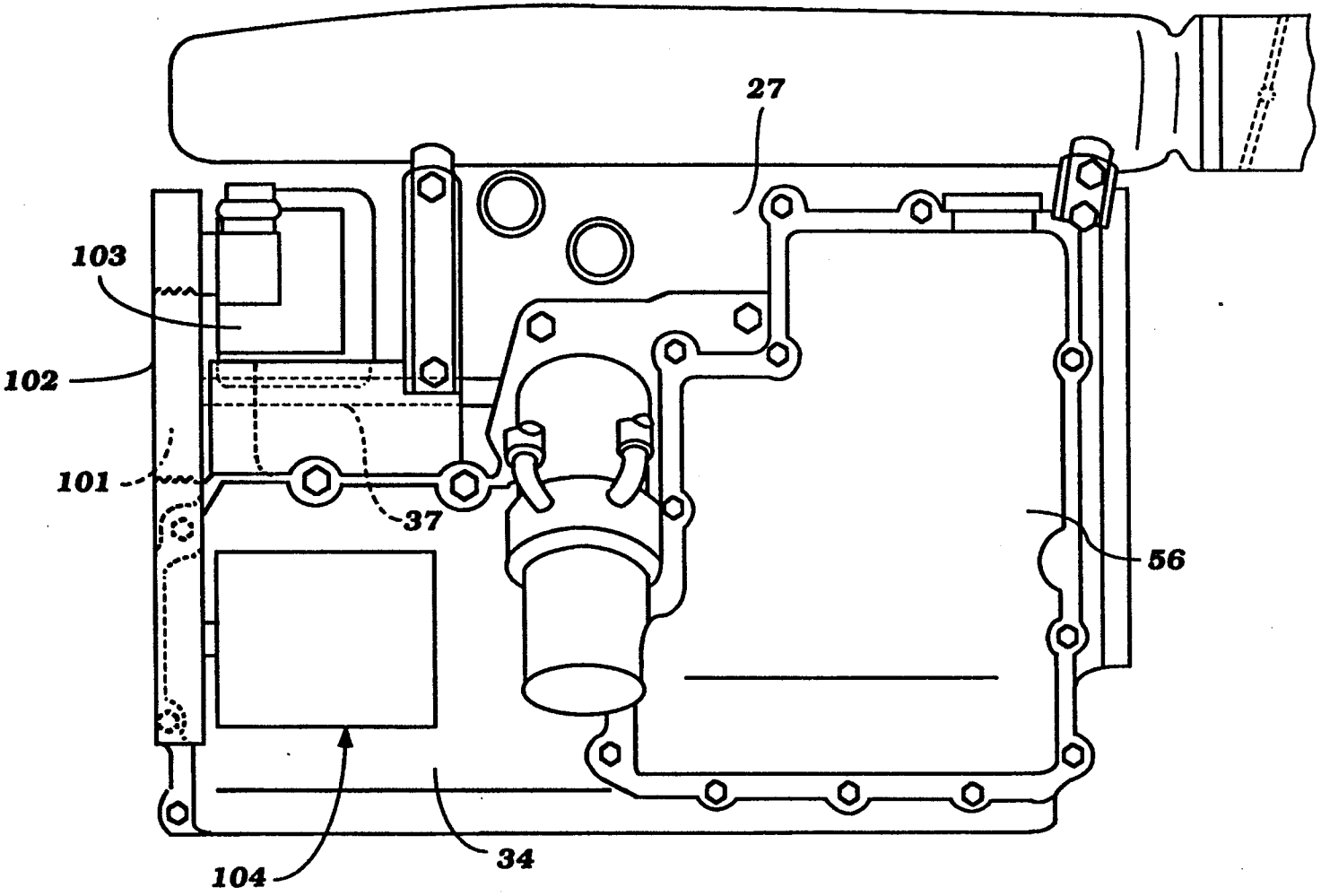
FIG. 4 is a front plan view of the power unit.
Figure 5:
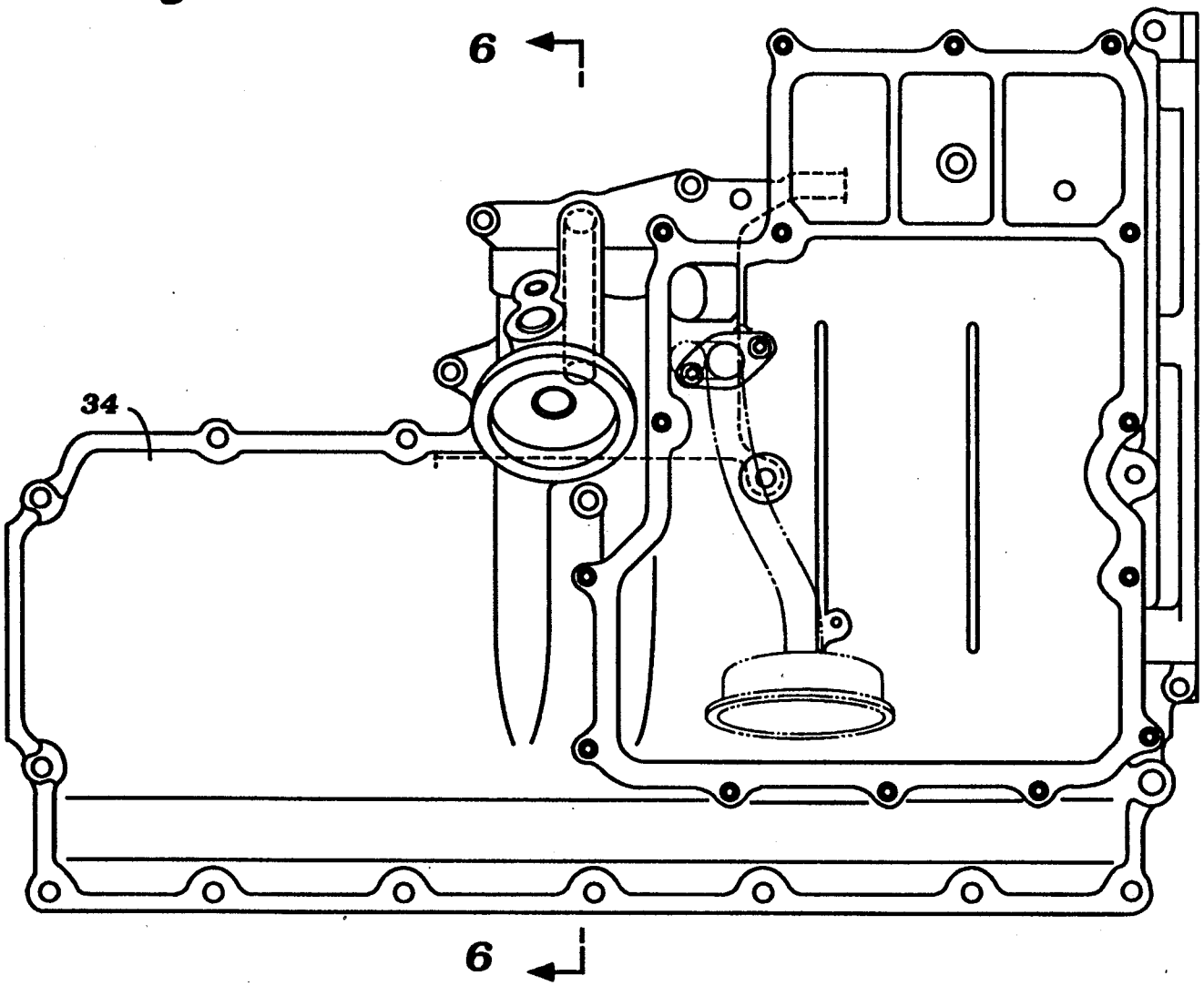
FIG. 5 is a view looking in the direction of the line 5—5 FIG. 3 and showing only the cylinder block with associated cover plates removed.

It should be noted that the output shaft 37 has a forwardly extending portion 98 that drives the pump assembly 57 as noted in aforenoted copending application Ser. No. 532,200. This shaft portion 97 lies outside of the crankcase and is journaled by a boss portion that is formed at the end of the crankcase opposite to the clutch 53 and which is formed with a recess 99 to accommodate a drive pulley 101 for driving a plurality of accessories as noted in the copending application entitled "Accessory Drive Arrangement For Engine", Ser. No. 548,019, filed July 5, 1990, in my name and the name of Kaoru Okui and assigned to the Assignee hereof. The disclosure of that application is also incorporated herein by reference. This accessory drive, however, includes a belt 102 that drives such accessories as a power steering pump 103 and air conditioning compressor 104 (FIG. 4).

Figure 15:
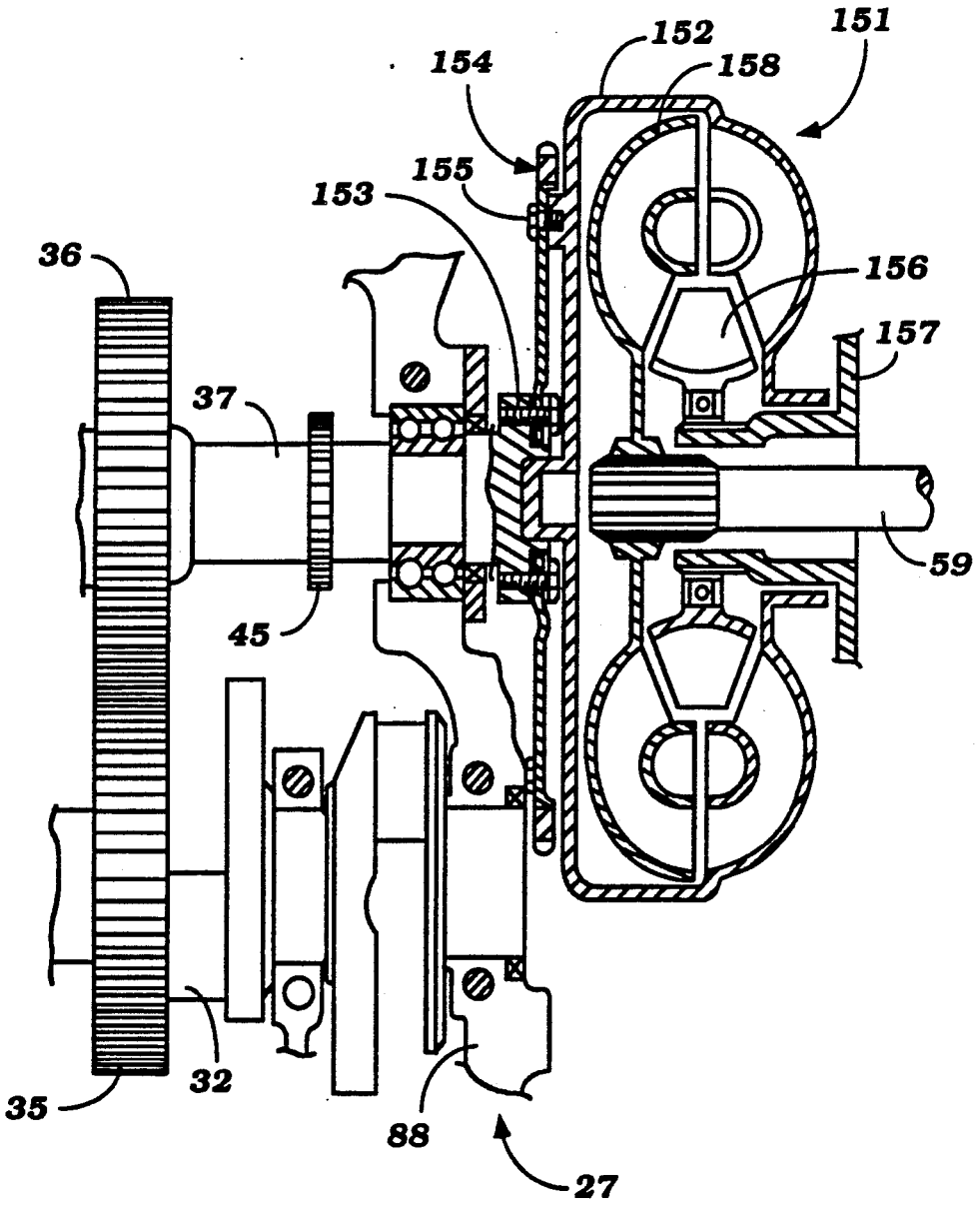
FIG. 15 is a partial view, in part similar to FIG. 7, with certain portions deleted, and shows another embodiment of the invention.

In the embodiment of the invention as thus far described, the power unit 24 has included a manual change speed transmission for driving the front wheels 22. Of course, it should be readily apparent to those skilled in the art that the power unit 24 can employ an automatic transmission as the drive mechanism. Such an arrangement is shown partially in FIG. 15. This figure corresponds generally to FIG. 7 of the previously described embodiment and due to the general similarities of this embodiment to that previously described embodiment, those components which are the same have been identified by the same reference numerals and will not be described again in detail. Also, the only portion of the automatic transmission which is depicted in this figure is the torque converter, which is identified generally by the reference numeral 151. The torque converter 151 includes a rotor 152 that is affixed to a hub of the output shaft 31 by fasteners 153 with a starter gear 154 also being so affixed by fasteners !55. The rotor 152 cooperates with a stator 156 that is affixed to a transmission case 157 and a driven turbine 158 that is splined to the transmission input shaft 159. Any type of automatic transmission may be employed with the torque converter 151. For this reason, further illustration of the transmission is not believed to be necessary.

It should be readily apparent from the foregoing description that the described construction provides a very robust and yet simple arrangement for journaling both a crankshaft for an engine and an output shaft driven by the crankshaft. The bearing member of the main bearings of the crankshaft also forms the closure for the crankcase and thus provides a compact, low cost and extremely rigid construction. The described balancing arrangement for the crankshaft permits a simple arrangement and yet affords a short overall length for the crankshaft and a compact engine construction. Although several embodiments of the invention have been illustrated and described, various changes and modifications may be made without departing from the spirit and scope of the invention, as defined by the appended claims.

I claim:

1. An internal combustion engine comprised of a cylinder block with a plurality of aligned cylinder bores, a crankcase portion formed in said cylinder clock at the base of said cylinder bores, a crankcase member affixed to said cylinder block crankcase portion and defining therewith, at least in part, a crankcase chamber, a crankshaft having a plurality of spaced bearings and journaled thereby within said crankcase chamber and driven by pistons contained within said cylinder bores, an output shaft journaled within said crankcase chamber for rotation about an axis parallel to the axis of rotation of said crankshaft and lying in a common plane therewith, and means for driving said output shaft from said crank shaft between the ends of said crankshaft, said crankcase chamber having a first longitudinally extending cavity in said plane containing said crankshaft and a second substantially shorter longitudinally extending cavity at one side of said first cavity and containing said output shaft.

2. An internal combustion engine as set forth in claim 1 wherein one end of the crankshaft is journaled by a first web portion formed by the crankcase portion of the cylinder block and the crankcase member and the adjacent end of the output shaft is journaled by a corresponding web of the crankcase portion of the cylinder block and the crankcase member that is offset inwardly from the corresponding webs of the crankshaft bearing.

3. An internal combustion engine as set forth in claim 2 wherein the means for driving the output shaft from the crankshaft comprises a first gear fixed to the crankshaft and a second gear fixed to the output shaft.

4. An internal combustion engine as set forth in claim 3 wherein the first gear is formed integrally one of the cheeks of the crankshaft adjacent a main bearing and the adjacent cheek of the crankshaft throw on the other side of said main bearing is not counter-balanced, but is formed as a disk like member.

5. An internal combustion engine as set forth in claim 4 wherein the crankcase member forms a plurality of integral main bearing caps for journaling the crankshaft.

6. An internal combustion engine as set forth in claim 5 wherein the crankcase member further forms the peripheral closure for the crankcase chamber.

7. An internal combustion engine as set forth in claim 6 wherein the output shaft further contains a driving sprocket for driving a camshaft of the engine.

8. An internal combustion engine as set forth in claim 6 wherein the engine powers a motor vehicle and the drive for the transmission of the motor vehicle is taken from the output shaft at the one end thereof.

9. An internal combustion engine as set forth in claim 1 wherein the crankcase member forms a plurality of integral main bearing caps for journaling the crankshaft.

10. An internal combustion engine as set forth in claim 9 wherein the crankcase member further forms the peripheral closure for the crankcase chamber.

11. An internal combustion engine as set forth in claim 1 wherein the first gear is formed integrally one of the cheeks of the crankshaft adjacent a main bearing and the adjacent cheek of the crankshaft throw on the other side of the said main bearing is not counter-balanced, but is formed as a disk like member.

12. An internal combustion engine as set forth in claim 1 wherein the aligned cylinder bores have their axes lying in a common plane that is disposed at an acute angle to the vertical.

13. An internal combustion engine as set forth in claim 12 wherein the plane containing the axis of rotation of the crankshaft an the axis of rotation of the output shaft is disposed at an acute angle to the vertical on the opposite side from the plane containing the cylinder bore axes and is disposed at an acute angle to the plane containing the cylinder bore axes.

14. An internal combustion engine as set forth in claim 13 wherein one end of the crankshaft is journaled by a first web portion formed by the crankcase portion of the cylinder block and the crankcase member and the adjacent end of the output shaft is journaled by a corresponding web of the crankcase portion of the cylinder block and the crankcase member that is offset inwardly from the corresponding webs of the crankshaft bearing.

15. An internal combustion engine as set forth in claim 14 wherein the means for driving the output shaft from the crankshaft comprises a first gear fixed to the crankshaft and a second gear fixed to the output shaft.

16. An internal combustion engine as set forth in claim 15 wherein the first gear is formed integrally one of the cheeks of the crankshaft adjacent a main bearing and the adjacent cheek of the crankshaft throw on the other side of the main bearing is not counter-balanced, but is formed as a disk like member.

17. An internal combustion engine as set forth in claim 16 wherein the crankcase member forms a plurality of integral main bearing caps for journaling the crankshaft.

18. An internal combustion engine as set forth in claim 17 wherein the crankcase member further forms the peripheral closure for the crankcase chamber.

19. An internal combustion engine as set forth in claim 18 wherein the output shaft further contains a driving sprocket for driving a camshaft of the engine.

20. An internal combustion engine as set forth in claim 18 wherein the engine powers a motor vehicle and the drive for the transmission of the motor vehicle is taken from the output shaft at the one end thereof.

21. An internal combustion engine as set forth in claim 12 wherein the crankcase member forms a plurality of integral main bearing cap for journaling the crankshaft.

22. An internal combustion engine as set forth in claim 13 wherein the crankcase member further forms the peripheral closure for the crankcase chamber.

23. An internal combustion engine as set forth in claim 12 wherein the first gear is formed integrally one of the cheeks of the crankshaft adjacent a main bearing and the adjacent cheek of the crankshaft throw on the other side of said main bearing is not counter-balanced, but is formed as a disk like member.

24. An internal combustion engine comprised of a cylinder block with a plurality of aligned cylinder bores, a crankcase portion formed in said cylinder block at the base of said cylinder bores and defined by an outer peripheral edge of said cylinder block crankcase portion, a crankcase member affixed to said cylinder block crankcase portion and defining therewith, at least in part, a crankcase chamber, a crankshaft having a plurality of spaced bearings and journaled thereby within said crankcase chamber and driven by pistons contained within said cylinder bores, said crankcase member comprising a unitary assembly forming a plurality of spaced bearing caps cooperating with bearings formed by said cylinder block for journaling said crankcase, said crankcase member further comprising an outer peripheral surface defining a closure around the said outer peripheral edge of said cylinder block crankcase portion.

25. An internal combustion engine as set forth in claim 24 wherein the aligned cylinder bores have their axes lying in a common plane that is disposed at an acute angle to the vertical.

26. An internal combustion engine as set forth in claim 25 further including an output shaft driven by the crankshaft and providing a power source from the engine.

27. An internal combustion engine as set forth in claim 26 wherein a plane containing the axis of rotation of the crankshaft and the axis of rotation of the output shaft is disposed at an acute angle to the vertical on the opposite side from the common plane containing the cylinder bore axes and is disposed at an acute angle to the plane containing the cylinder bore axes.

28. An internal combustion engine as set forth in claim 26 wherein the output shaft is also journaled by the crankcase member and the cylinder block crankcase portion.

29. An internal combustion engine as set forth in claim 28 wherein one end of the crankshaft is journaled by a first web portion formed by the crankcase portion of the cylinder block and the crankcase member and the adjacent end of the output shaft is journaled by a corresponding web of the crankcase portion of the cylinder block and the crankcase member that is offset inwardly from the corresponding webs of the crankshaft bearing.

30. A crankshaft for an internal combustion engine having a plurality of main bearing portions and connecting rod journal portions offset from main bearing portions by throws defined by pairs of cheeks, one of said cheeks being formed with an integral gear portion for driving an accessory shaft adjacent one of said main bearing portions, the adjacent cheek on the other side of said one main bearing portion being a disk like configuration and not counterbalanced, at least certain of the remaining throws being counterbalanced, said disk like member and said gear being offset from a center main bearing of the crankshaft and wherein cheeks offset to the opposite side of said center bearing at the same distance from said center main bearing also are not counterbalanced.

31. An internal combustion engine comprised of a cylinder block with a plurality of aligned cylinder bores having their axes lying in a common plane that is disposed at an acute angle to the vertical, a crankcase portion formed in said cylinder block at the base of said cylinder bores, a crankcase member affixed to said cylinder block crankcase portion and defining therewith, at least in part, a crankcase chamber, a crankshaft having a plurality of spaced bearings and journaled thereby within said crankcase chamber and driven by pistons contained within said cylinder bores, said crankcase member comprising a unitary assembly forming a plurality of spaced bearing caps cooperating with bearings formed by said cylinder block for journaling said crankcase, said crankcase member defining a closure around the peripheral edges of said cylinder block crankcase portion and an output shaft driven by said crankshaft and providing a power source from said engine, the plane containing the axis of rotation of said crankshaft and the axis of rotation of the output shaft being disposed at an acute angle to the vertical on the opposite side from the common plane containing said cylinder bore axes and disposed at an acute angle to the common plane containing the cylinder bore axes.

32. An internal combustion engine as set forth in claim 31 wherein the output shaft is also journaled by the crankcase member and the cylinder block crankcase portion.

33. An internal combustion engine as set forth in claim 32 wherein one end of the crankshaft is journaled by a first web portion formed by the crankcase portion of the cylinder block and the crankcase member and the adjacent end of the output shaft is journaled by a corresponding web of the crankcase portion of the cylinder block and the crankcase member that is offset inwardly from the corresponding webs of the crankshaft bearing.

* * * * *